US006766723B2

(12) United States Patent
Yasoda et al.

(10) Patent No.: US 6,766,723 B2
(45) Date of Patent: Jul. 27, 2004

(54) MULTIAXIS PUNCH DEVICE

(75) Inventors: Hisashi Yasoda, Ishikawa-ken (JP); Takashi Tsuchida, Ishikawa-ken (JP)

(73) Assignee: UHT Corporation, Aichi-ken (JP)

( * ) Notice: Subject to any disclaimer, the term of this patent is extended or adjusted under 35 U.S.C. 154(b) by 106 days.

(21) Appl. No.: 10/106,442

(22) Filed: Mar. 27, 2002

(65) Prior Publication Data

US 2002/0139233 A1 Oct. 3, 2002

(30) Foreign Application Priority Data

Mar. 30, 2001 (JP) ..... 2001-101403

(51) Int. Cl.[7] ..... B26D 5/08

(52) U.S. Cl. ..... 83/549; 83/405; 83/513; 83/681; 83/683

(58) Field of Search ..... 83/549, 541, 405, 83/513, 681, 698.91, 698.61, 140, 571, 689

(56) References Cited

U.S. PATENT DOCUMENTS 2,458,160 A * 1/1949 Grappe ..... 83/549
3,034,641 A * 5/1962 Kochan ..... 29/566
3,275,233 A * 9/1966 Frankel ..... 234/1
3,334,809 A * 8/1967 Zajic et al. ..... 234/106
4,457,196 A * 7/1984 Cady ..... 83/140
4,898,056 A * 2/1990 Grobb et al. ..... 83/689
5,301,585 A * 4/1994 Hosaka ..... 83/549

* cited by examiner

*Primary Examiner*—Allan N. Shoap
*Assistant Examiner*—Phong Nguyen
(74) *Attorney, Agent, or Firm*—Greenblum & Bernstein, P.L.C.

(57) ABSTRACT

A grid pattern punch type multiaxis punch device is capable of simultaneously punching punched holes of the same shape showing different shapes for every location at each of the same positions in each of the areas defined in a work. Every time a work is moved in X-axis, Y-axis directions under its controlled state, a hammer holder is moved in a horizontal direction under its controlled state, a punch drive source (a servo motor) is driven under a state in which hammers are corresponded just above optional punches at the same positions in each group of units, each of the punches present at the same positions in the group of units is punched by each of the hammers, thereby the punch holes having the same shapes showing different shapes for every location are punched simultaneously at each of the same locations within each area defined in the work.

12 Claims, 9 Drawing Sheets

MULTIAXIS PUNCH DEVICE

BACKGROUND OF THE INVENTION

1. Field Of The Invention

This invention relates to a multiaxis punch device for use in performing a punch operation by a grid pattern punch system.

2. Description Of The Related Art

As the multiaxis punch device in the related art, there are provided a gang-die punch system and a grid pattern punch system. The gang-die punch system is comprised of a punch holding type for holding a plurality of punches and reciprocated through driving of the punch drive source and a die holder fixedly arranged against the reciprocating (punch) motion of the punch holding type, all the punch holes having the same shape to each other are punched at once in areas defined while being spaced apart on a vertical row and a lateral row of works moved under control in X-axis and Y-axis directions held in the work holding mechanism.

In turn, the grid pattern punch system is operated such that the punches are held at the punch holding die in the same pitch as that of the areas defined on the vertical and lateral rows of the works, and the punch holes having the same shape to each other are punched at the same positions in each of the areas of the work held by the work holding mechanism and moved under a controlled state in X-axis and Y-axis directions.

In the case of the aforesaid grid pattern punch system, a pitch of the punched holes can be set to a desired value as compared with that of the gang die punch system and so the grid pattern punch system is preferable for a fine punch operation where the punched holes are closely near to each other.

Further, the work such as a ceramics green sheet or the like is not only machined into an inductor (a product) requiring a plurality of punched holes having the same shape to each other, but also machined into a package (a product) requiring punched holes having a desired shape showing different shapes to each other or the like.

As described above, in the case that some punched holes having desired shape are to be punched for every location of the same position in the areas defined in the work, a plurality of multiaxis punch devices for the grid pattern punch system are manufactured and prepared, each of the multiaxis punch devices is provided with each of some punched holes of the desired shape in the same pitch as the area pitch, thereby the work is moved around each of the multiaxis punch devices so as to punch the punched holes having the desired shape for every location of the same position in each of the areas defined in the work or some monoaxis punch devices holding some punches having different shapes are arranged side by side, and the work is moved around each of the monoaxis punch devices to punch the punched holes having the desired shape for every locations of the same position of each of the areas defined in the work.

However, whatever type of the punch device may be used, the system for moving around the work has some problems in which not only the entire machine becomes large in size to occupy a space, but also its facility cost is substantially increased, and a moving distance of the work becomes quite long when the holes are punched, it takes much moving time and its productivity becomes remarkably deteriorated.

SUMMARY OF THE INVENTION

The present invention has been invented in view of the aforesaid circumstances found in the prior art and it is an object of the present invention to provide a multiaxis punch device of grid-pattern punch system in which some punched holes having the same shapes showing different shapes for every location can be punched simultaneously at each of the same positions in each of the areas defined in the work.

A technical means applied for resolving the aforesaid object is characterized in that a punch holder having many punches inserted, arranged and supported by some springs for their returning motion is arranged above a die holder for holding a die in such a way that the punch holder can be moved up and down;

a hammer holder provided with a hammer for striking against some punches is arranged above said punches and a punch drive source is mounted above the hammer holder;

said hammer is arranged at the hammer holder adjacent to each of the punches at the same positions of each of the groups of units with a desired number of punches of a predetermined same arranging pattern being applied as one group;

said hammer holder can be moved in a horizontal direction under its controlled state when said punch drive source is not driven, reciprocated with a driving force when said punch drive source is driven and the punches at the same positions in each of the group units can be punched by each of the hammers; and a plurality of punches showing different shapes in each of said group units are contained and the punches at the same positions in each of the group units have the same shape to each other.

In this case, each of the punches at the same positions in each of the unit groups with a desired number of punches having said predetermined same arrangement pattern being applied as one group has the same pitch as the pitch between the areas defined in the work in each of the unit groups.

In addition, the punch of each of the unit groups includes punches having all different shapes and some of a plurality of punches having different shapes, and the remaining punches include both types of punches when they have a similar shape to each other.

In accordance with the aforesaid technical means, the hammer holder is moved in a horizontal direction under its controlled state every time the work is moved under its controlled state in X-axis and Y-axis directions, the punch drive source is driven under a state in which the hammer is corresponded just above the optional punches at the same positions in each of the unit groups, each of the punches present at the same positions in the unit groups is struck to cause the punched holes having the same shapes to be punched at the same positions in each of the areas defined in the work.

Further, since the punches in each of said unit groups include a plurality of punches having different shapes and the punches at the same positions in each of the unit groups have the same shape to each other, it is possible to perform a simultaneous punch of the punched holes having the same shape showing different shapes for every location at each of the same positions in each of the areas defined in the work.

DESCRIPTION OF THE PREFERRED EMBODIMENT(S)

Figure 9:
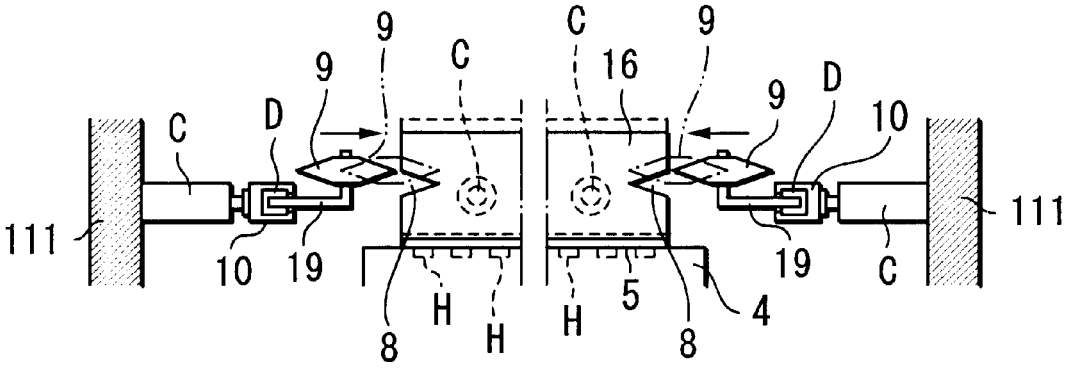
FIG. 9 is a schematic diagram for showing a modification of a constitution in which the hammer holder can be moved in a horizontal direction under its controlled state when a punch drive source is not driven, and the punch holder returns back with a drive force when a punch drive source is driven to enable the punches at the same positions in each of the unit groups to be punched by each of the hammers, wherein it shows a state in which a lifter is engaged with a V-groove formed in an intermediate member to lift up the intermediate member.
Figure 10:
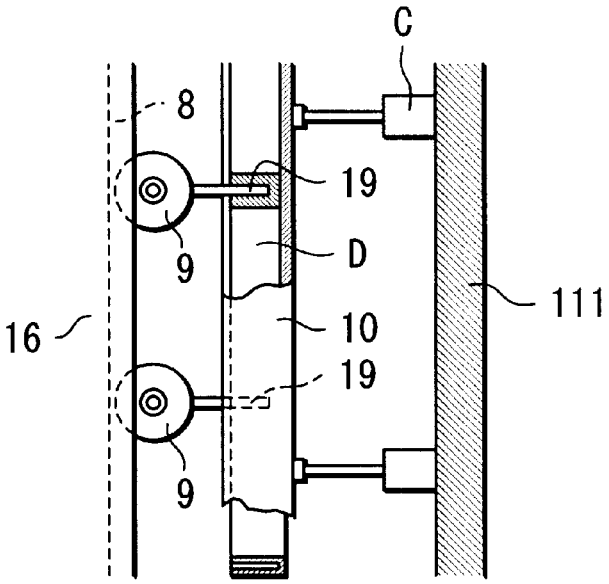
FIG. 10 is a substantial top plan view with a part being broken away for showing a relation of a lifter, a sliding member, a longitudinal supporter and a cylinder.
Figure 11:
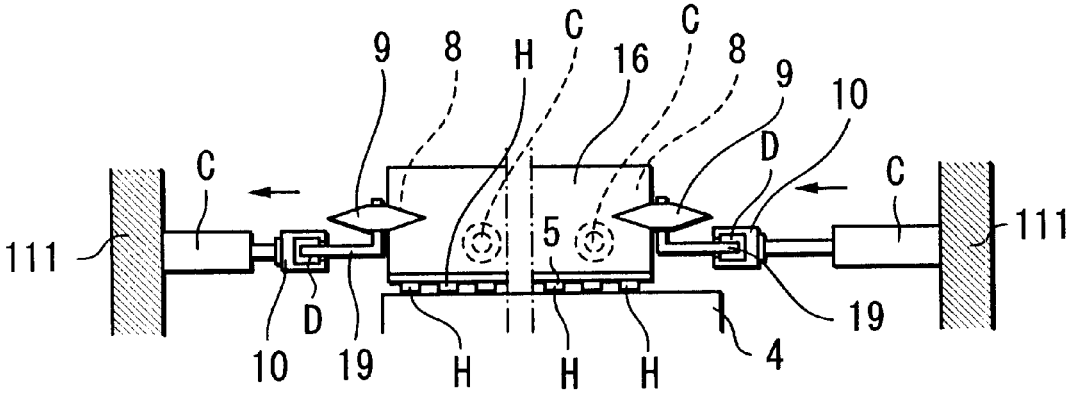
FIG. 11 is a schematic view for showing a state in which the intermediate member is moved in a horizontal direction under its controlled state.

Referring to the accompanying drawings, one preferred embodiment of the multiaxis punch device of the present invention will be described as follows, wherein FIGS. 1 to 8 illustrate a first preferred embodiment of the present invention and FIGS. 9 to 11 illustrate a second preferred embodiment of the present invention, respectively. At first, the first preferred embodiment will be described, wherein reference symbol A denotes a multiaxis punch device.

Figure 1:
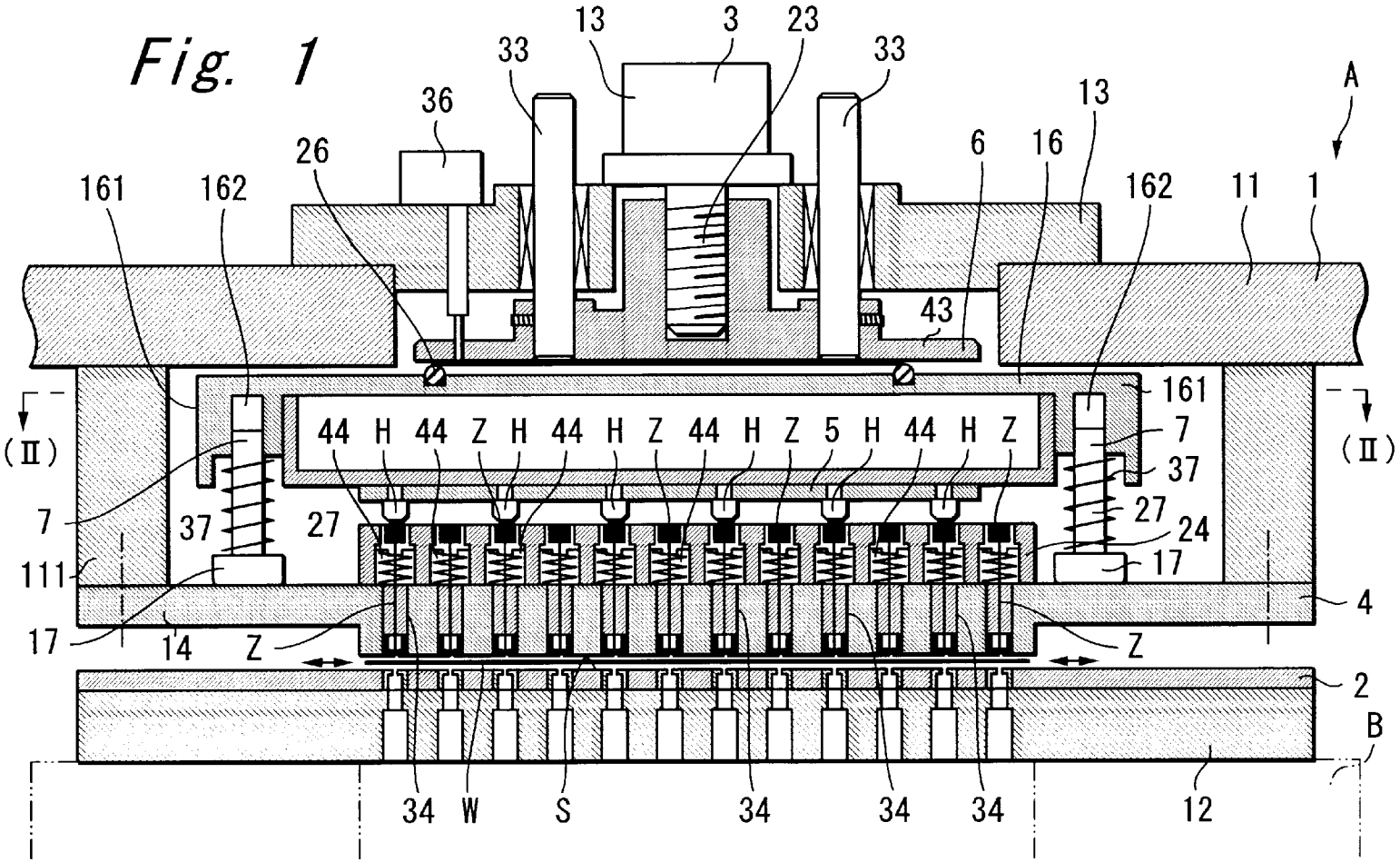
FIG. 1 is a longitudinal sectional view for showing a multiaxis punch device in accordance with a first preferred embodiment in its stage before punch operation.
Figure 2:
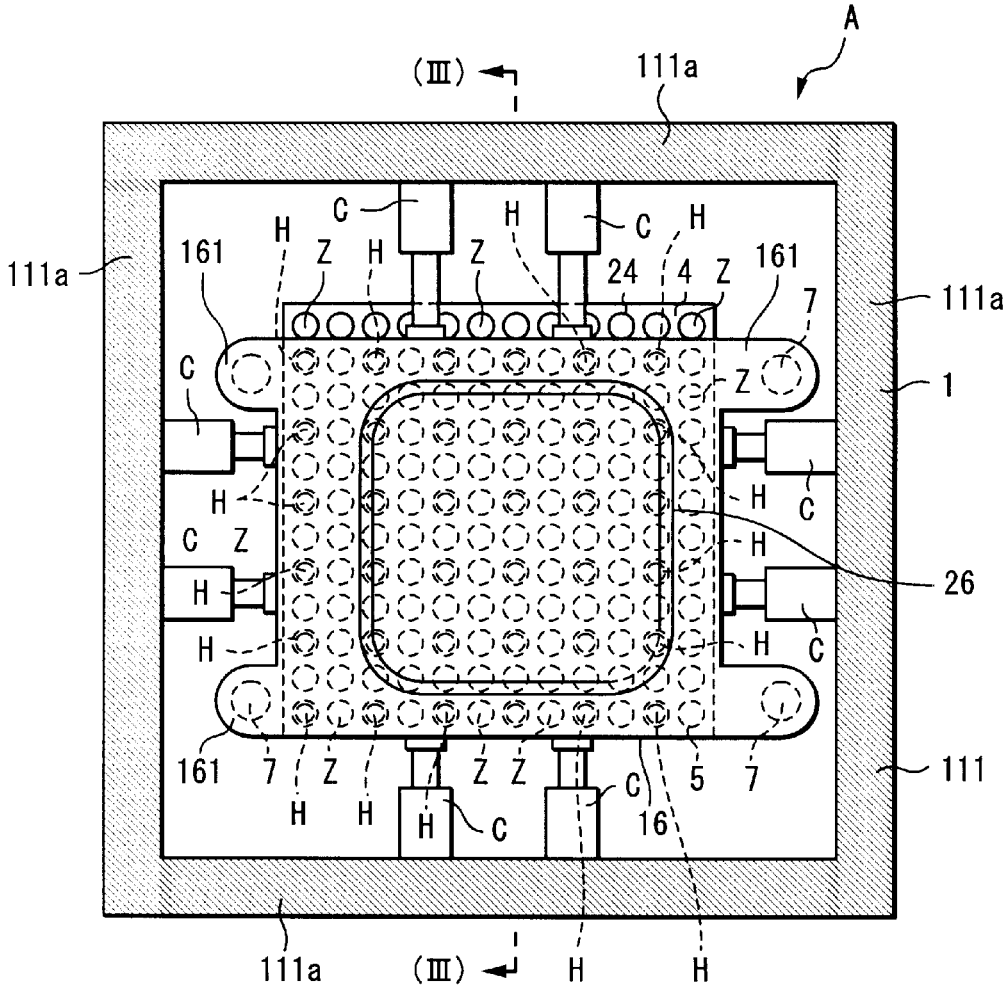
FIG. 2 is a sectional view taken along line (II)-(II) of FIG. 1 for schematically showing a relation between a punch and a hammer.
Figure 3:
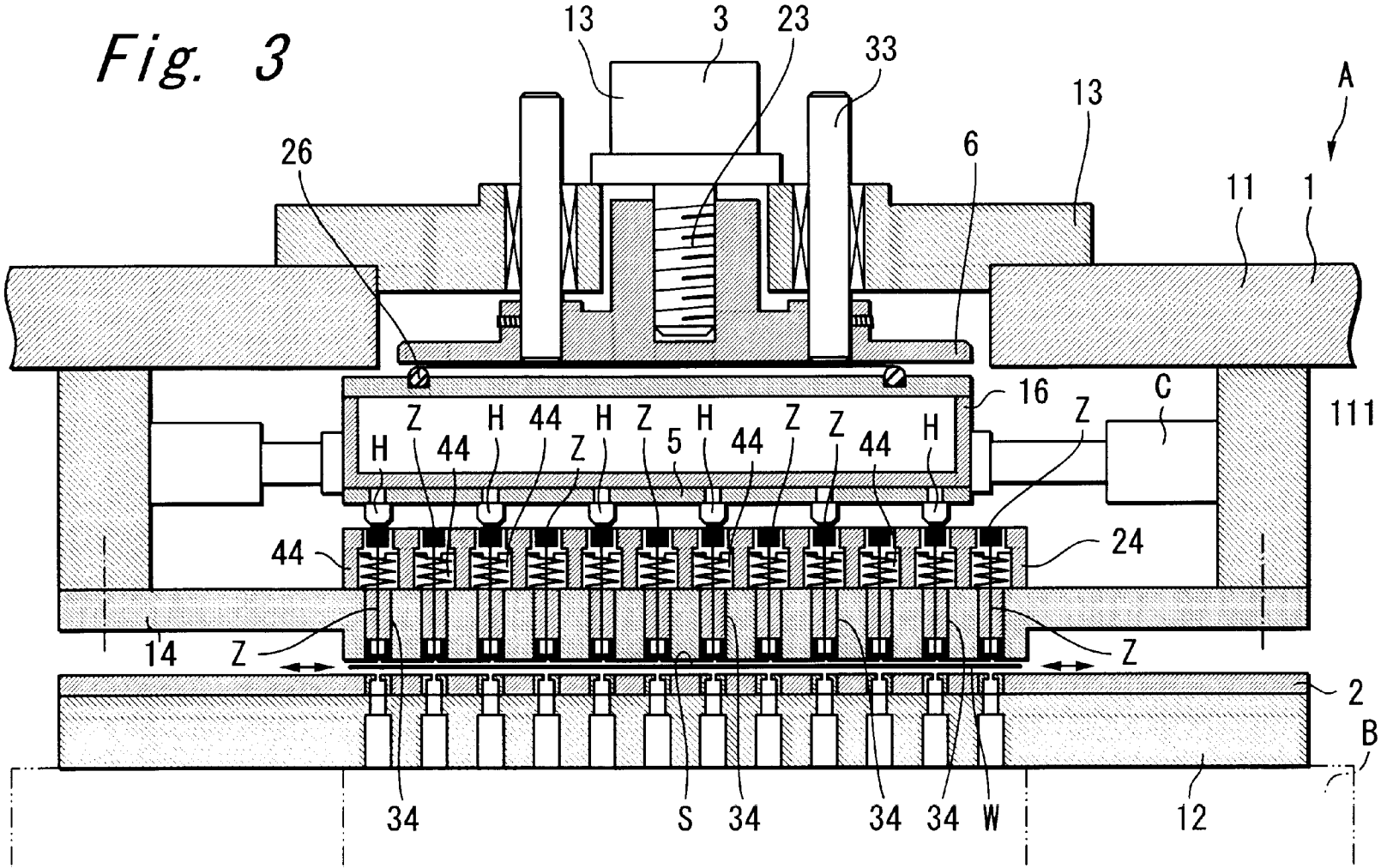
FIG. 3 is a sectional view taken along line (III)-(III) of FIG. 2.

As shown in FIG. 1 and the like, this multiaxis punch device A is comprised of a machine frame 1 of gate-shape as seen in its front elevational view capable of being moved and down with a top plate 11 having an opening at its central part as shown in FIG. 1 or the like being applied as a top frame; a die holder 2 mounted at a fixed base B within the machine frame 1; a punch drive source 3 mounted at a fixing table 13 arranged at the upper surface of said top plate 11 so as to close said opening; a punch holder 4 fixedly arranged at said machine frame 1; and a hammer holder 5 arranged above the punch holder 4.

As shown in FIGS. 1, 3, 6 and 8, the punch holder 4 is comprised of a first plate 14 fixed with screws to the lower end of a supporting frame 111 fixed to the top plate 11 of the aforesaid machine frame 1; and a second plate 24 fixed to the upper surface of the first plate 14, wherein some punch insertion through-holes 34 are equally spaced apart and opened in vertical and lateral rows at the first plate 14, and some punch holding holes 44 are coaxially opened at the second plate 24 with the punch insertion through-holes 34.

Figure 5:
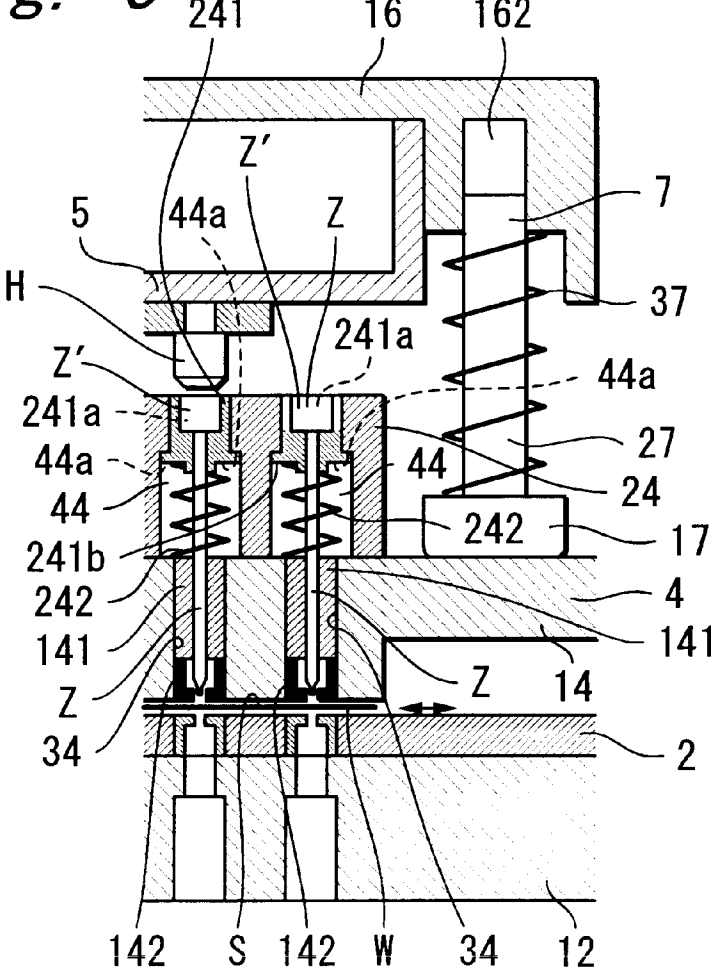
FIG. 5 is an enlarged sectional view for showing a substantial part.
Figure 7:
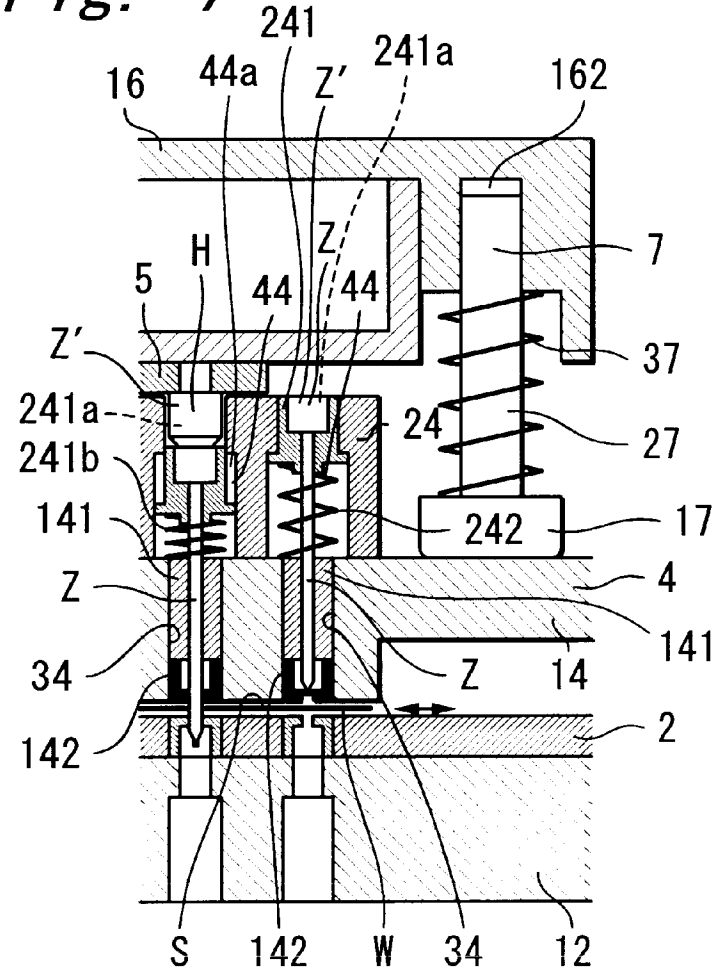
FIG. 7 is an enlarged sectional view of a substantial part for showing a punched state.

The first plate 14 is a punch plate, and as shown in FIGS. 5 and 7, a guide sleeve 141 of a punch Z is fitted and inserted into an upper half segment of said punch insertion through-hole 34, and a stripper 142 is fitted and inserted into a lower half segment of said punch insertion through-hole 34.

The second plate 24 is a punch holder, and as shown in FIGS. 5 and 7, the upper half segment of said punch holding hole 44 has a smaller diameter than that of the lower half segment, a punch holding block 241 having an engaging flange 241*b* engaged with a step segment 44*a* between a storing notch 241*a* storing a head part Z' of the punch Z and the lower half segment is inserted into and fitted to the upper half segment of the punch holding hole 44, and a returning spring 242 is stored at the lower half segment of the punch holding hole 44 around the engaging flange 44*a* and the upper surface of said first plate 14.

In addition, the head Z' of the punch Z is in flush with the upper surface of the second plate 24 while the engaging flange 241*b* of the punch holding block 241 is being engaged with the step segment 44*a* of the punch holding hole 44.

Then, the heads Z'. . . of the punches Z . . . are struck to cause the punch holding block 241 to be moved forward and to compress the returning spring 242, the punches Z . . . are projected from the strippers 142 . . . , the work W transferred into the work transferring space S between the first plate 14 and the die holder 2 is punched with some punched holes, and when no striking load is applied to the work, the engaging flange 241*b* is ascended up to a location where it is engaged with the step segment 44*a* of the punch holding hole 44 under application of a recovering force of the returning spring 242, the punch Z is returned and stored in the stripper 142 (Refer to FIGS. 5 and 7).

The punches Z . . . having the same shape to each other are inserted and arranged at the same position of each of the unit groups T (within the circle indicated by a two-dotted line in FIG. 4) where the required number of punches having a predetermined arrangement pattern is applied as one group.

Figure 4:
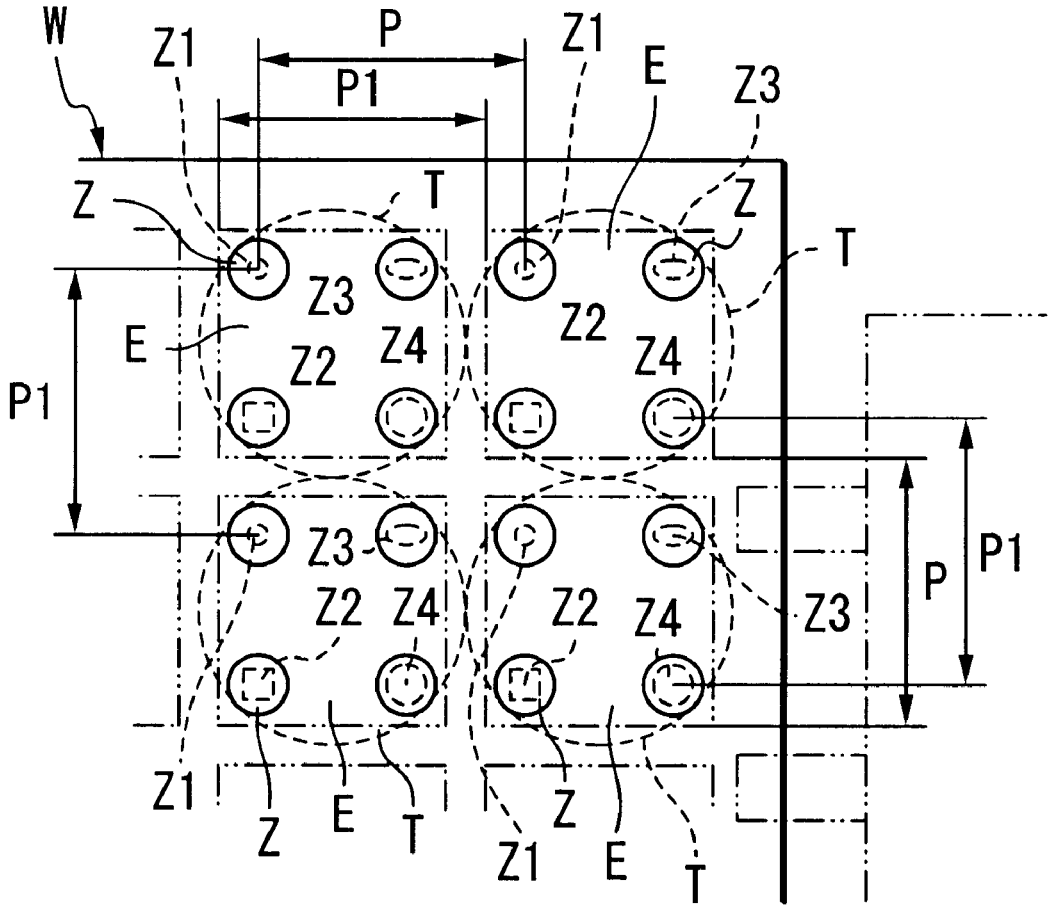
FIG. 4 is an enlarged top plan view for showing a pitch relation between an area defined in a work and each of the punches in a group of units.

A pitch P1 of each of the punches Z . . . at the same positions of each of the unit groups T described above is set to be the same as a pitch P between the areas E defined on the vertical row and the horizontal row in the work W between each of unit groups T as indicated in FIG. 4.

The striking drive source 3 is comprised of a servo-motor 13 acting as a drive source; a screw 23 directly connected to the servo-motor 13; and a block member 43 which is moved up and down under its controlled state through guides 33, 33 while the screw 23 is being rotated in a normal or reversing direction. The block member 43 and the hammer holder 5 are constructed such that they can be disconnected.

This connecting means 6 is comprised of an O-ring 26 having the hammer holder 5 arranged at any one of the upper surface of a box-like intermediate member 16 fixed to the lower surface and the lower surface of the block member 43; and a vacuum means 36 for sucking air between the lower surface of the block member 43 and the upper surface of the intermediate member 16 closely contacted to each other to collapse the O-ring 26 when the servo motor 13 is driven and for adsorbing the block member 43 and the intermediate member 16 in such a way that they can be released.

Above the punches Z . . . at the same positions of each of the unit groups T described above, the hammer holder 5 is provided with hammers H . . . projected adjacent to the punches Z . . . .

In addition, the hammer holder 5 is supported in a horizontal state by a leg structure in which arms 161 . . . projected horizontally from four corners of the intermediate member 16 having a guide groove 162 at a lower surface and a compression spring 37 is arranged around a shaft 27 between a seat segment 17 of a supporting leg 7 having the shaft 27 inserted into and fitted to the guide groove 162 in such a way that the shaft can be guided and the lower surfaces of the arms 161 . . . , no load is applied when the connecting means 6 is released in its connected state (when the servo motor is not driven), i.e. at the time of top dead center of the block member 43, so that the hammers H . . . may accept a resilient force of the compression spring 37 so as not to be interfered with the punch holder 4 and ascend, they are pushed and drawn by cylinders C . . . arranged at each of the surfaces 111*a* of the supporting frame 111 opposing against each of the side surfaces of the intermediate member 16 capable of being moved in a horizontal direction under its controlled state in forward, rearward, rightward and leftward directions, respectively, and the seat segment 17 of the supporting leg 7 is molded by material showing superior sliding characteristic such as Teflon (PTFE), for example, so as to perform a smooth controlled motion in its horizontal direction.

The vacuum means 36 has a function in which it operates to connect the block member 43 with the intermediate member 16 when the block member 43 is closely contacted with the upper surface of the intermediate member 16 at the time of punch driving to drive the servo motor 13 (rotating in a normal direction) and it releases a connected state between the block member 43 and the intermediate member 16 having the hammer holder 5 at the time of returning operation for driving the servo motor 13 (rotating in an opposite direction), and when the connected state is released to attain its top dead center to cause the connected relation under the sucked state of the block member 43 to be eliminated, the intermediate member 16 having the hammer holder 5 therein ascends with a resilient force of the compression spring 37 and it can be moved in a horizontal direction under its controlled state by the cylinders C . . . .

The die holder 2 is a die holder that is fixed above the fixed base B through a die pat 12, and the punch holder 4 can adjust the work loading space S against the die holder 2 while being moved up and down against the machine frame 1.

It is assumed that the multiaxis punch device of the preferred embodiment constructed as described above is formed such that two vertical and horizontal rows are applied as one group (four punches), as shown in FIG. 4, for example, and a round punch Z1, a rectangular punch Z2, an elliptical punch Z3 and a large diameter round punch Z4 or the like are held at the same position of each of the unit groups T.

Figure 6:
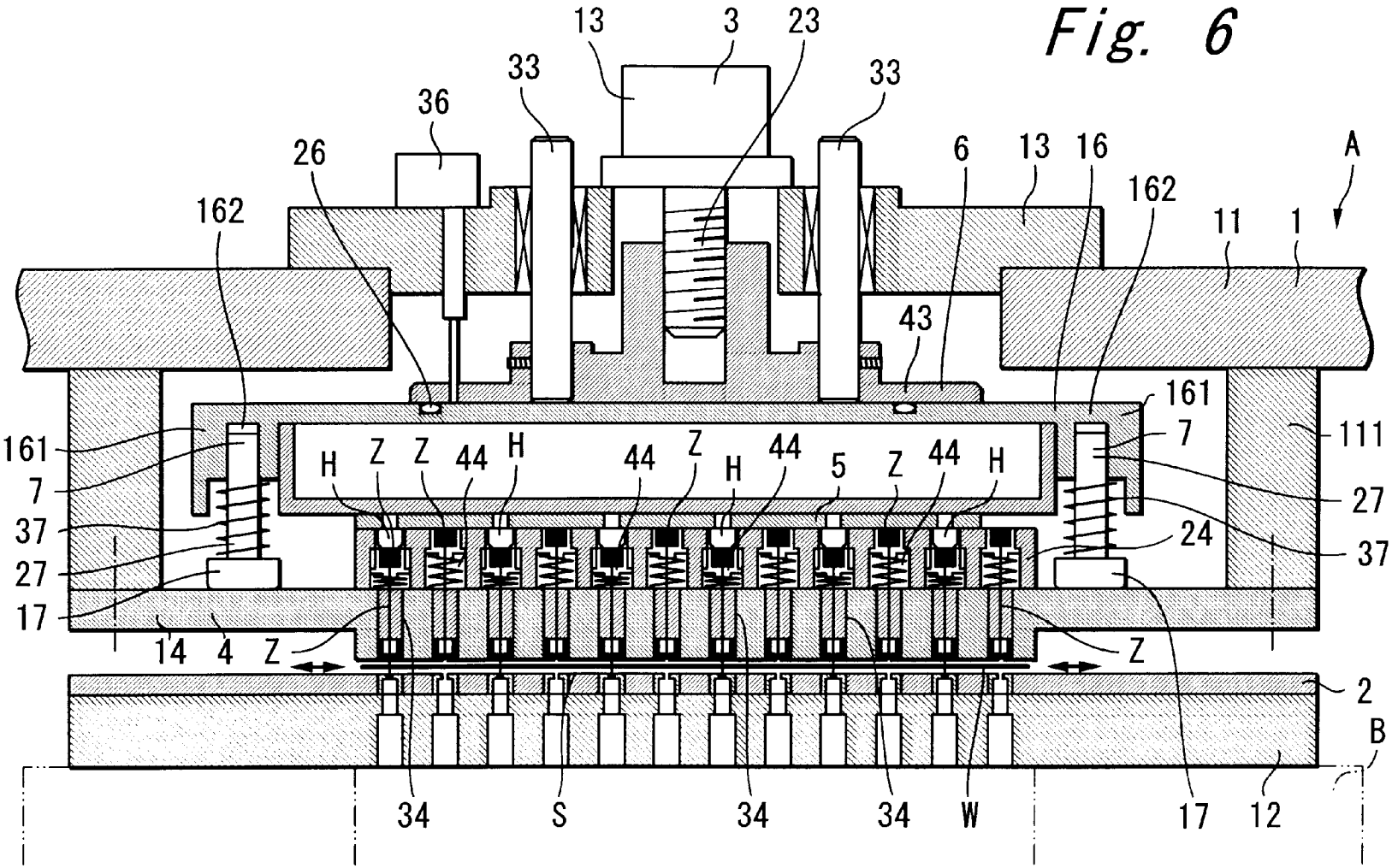
FIG. 6 is a longitudinal sectional view for showing a punched state.
Figure 8:
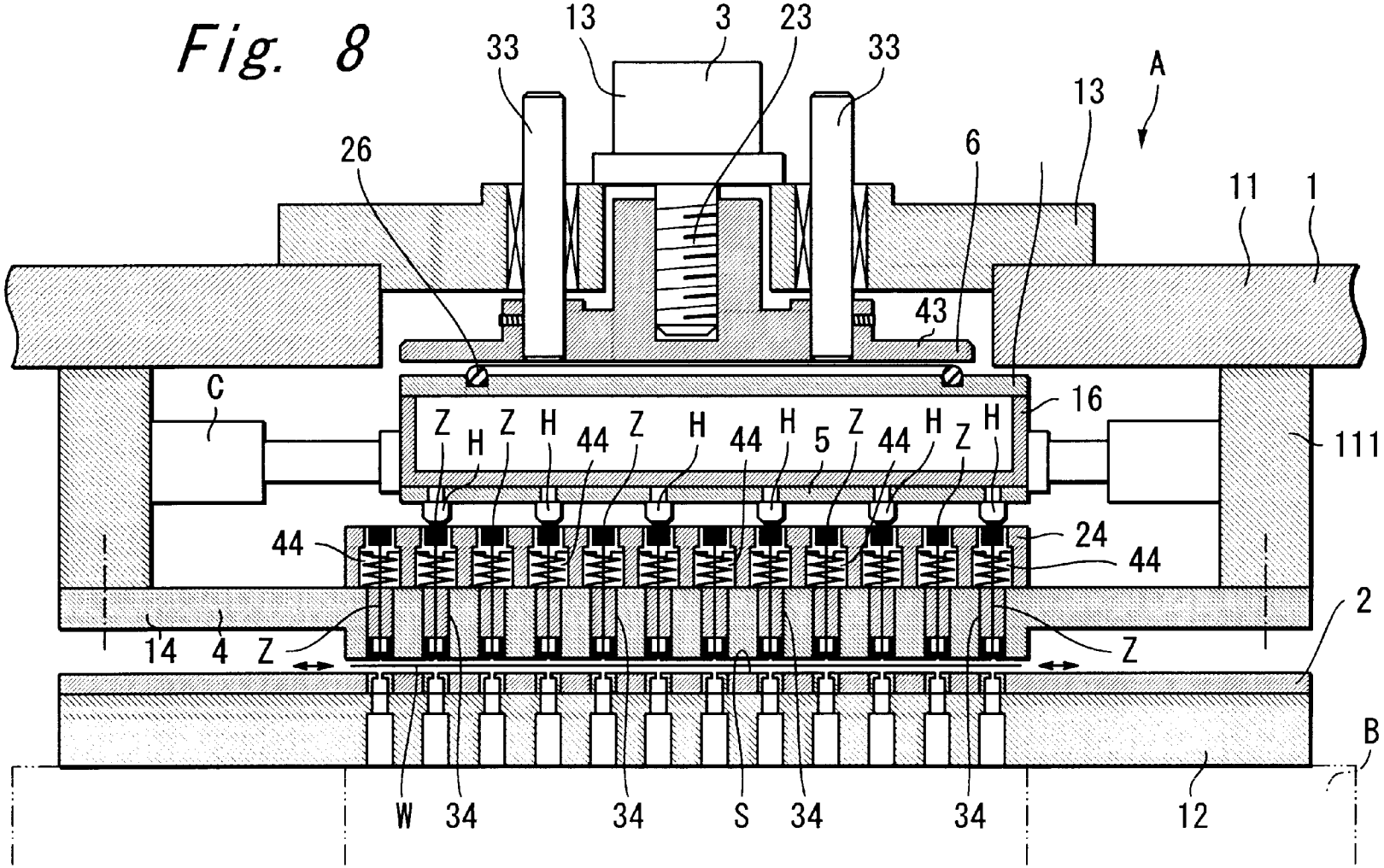
FIG. 8 is a sectional view taken along line (III)-(III) of FIG. 2 described above, wherein it shows a state in which a hammer holding member is moved in a horizontal direction under its controlled state to cause the hammer to be moved just above another punch.

Then, the work W is moved under its controlled state in X-axis and Y-axis directions from the time when the servo motor 13 is not driven as shown in FIGS. 1, 2, 3 and 5, the vacuum means 36 is operated when the O-ring 26 is collapsed with the block member 43 and the upper surface of the intermediate member 16 to connect the block member 43 and the intermediate member 16 through sucking action while driving the servo motor 13 (rotating in a normal direction), the intermediate member 16 returns to compress the compression spring 37 of the supporting leg 7 together with the block member 43 through a further rotation of the screw 23 in its normal direction, each of the round punches Z1 . . . kept at the same positions in each of the unit groups T is struck by each of the hammers H . . . to make a simultaneous punching of the round punched holes at the same positions of each of the areas E . . . defined in the work W (FIGS. 6 and 7).

Subsequently, when the servo motor 13 is operated (rotated in an opposite direction) to cause the block member 43 to be ascended and the intermediate member 16 becomes unloaded state while the connected state of the intermediate member 16 with the block member 43 is released under its air-pushed state by the vacuum means 36, the compression spring 37 is extended to cause each of the hammers H . . . to be moved away from the punch holder 4 in an upward direction, the cylinders C . . . are pushed or drawn under its state, the intermediate member 16 is moved under its controlled state in a horizontal direction, each of the hammers H . . . is positioned just above each of the punches at the requisite adjoining same positions at each of the unit groups T (refer to FIG. 8), the work W is moved under its controlled state in X-axis and Y-axis directions, the aforesaid operation is carried out again to strike against the hammer holder 5 to perform a simultaneous punching of the rectangular punched hole, for example, at the same positions of each of the areas E.

In this way, driving (rotation in a normal direction) of the servo motor 13, connection between the block member 43 and the intermediate member 16 under sucking action at the vacuum means 36, further driving (rotation in a normal direction) of the servo motor 13, driving of the servo motor 13 (rotation in an opposite direction), releasing of the connected state between the block member 43 and the intermediate member 16 with air pushing operation from the vacuum means 36 and motion of the intermediate member 16 with the cylinders C . . . , i.e. motion of the hammer H just above the optional punch Z under a horizontal controlled motion of the hammer holder 5 are carried out in sequence every time the work W is moved under its controlled state in X-axis and Y-axis directions, resulting in that a round punched hole, a rectangular punched hole, an elliptical punched hole and a large diameter round punched hole and the like can be punched simultaneously for respective punches at each of the same positions in each of the areas E.

Then, a second preferred embodiment of the present invention will be described as follows. The second preferred embodiment shows another modified example of a practical configuration in which the hammer holder 5 can be moved under its controlled state in a horizontal direction at the time of non-driving state of the striking drive source (the servo motor 13), the hammer holder 5 moves forward with a driving force at the time of driving of the striking drive source (the servo motor 13) to enable the punches Z at the same positions of each of the unit groups T with each of the hammers H . . . to be struck.

In FIGS. 9 to 11, reference numerals 8, 8 denote a V-groove notched over an entire length of a surface at the same height positions in a pair of side surfaces of any of forward, rearward, rightward and leftward surfaces in the four circumferential side surfaces of an intermediate member 16 having the hammer holder 5 at its lower surface.

Then, abacus counter-shaped lifters 9, 9 having slant surfaces engaged in surface with the V-grooves 8, 8 from their sides to ascend the intermediate member 16 are pivotally supported by a pair of supporting shafts 19, 19 spaced apart in a longitudinal direction of the V-grooves 8, 8 in such a way that they can be turned in a horizontal direction, a slider D having each of the base ends of a pair of supporting shafts 19, 19 is slidably fitted to a long supporting member 10, the slider can be pushed or retracted by a cylinder C arranged over the long supporting member 10 and the supporting frame 111, and a pair of remaining surfaces at forward, rearward, rightward and leftward surfaces of the intermediate member 16 are pushed or retracted by a cylinder C arranged at the supporting frame 111 in the same manner as that of the aforesaid preferred embodiment.

In this modified example, when the servo motor 13 is driven (rotated in an opposite direction) to cause the block member 43 to be ascended and it is pushed with air got from the vacuum means 36 to release the connected state of the intermediate member 16 against the block member 43, each of the long supporting members 10, 10 is pushed with the cylinders C, C, each of the lifters 9, 9 is engaged in surface with each of the opposing V-grooves 8, 8 and the intermediate member 16 is lifted upwardly above the punch holder 4 (refer to FIG. 9) in such a way that the hammers H . . . do not interfere with the punches (not shown), thereafter the state having each of the lifters 9, 9 engaged with the V-grooves 8, 8 is maintained and each of the hammers H . . . can be positioned just above each of the punches at the desired same positions in each unit groups T by pushing and retracting the cylinder C and the remaining cylinders C (FIG. 11).

In the case that the remaining cylinder C described above is pushed or retracted, the slider D described above slides in each of the long supporting members 10, 10.

Then, the cylinders C supporting the long supporting members 10, 10 are retracted synchronously and the intermediate member 16 having the hammer holder 5 at its lower surface is mounted at the punch holder 4, the servo motor 13 is driven (rotated in a normal direction) under this state, the block member 43 and the intermediate member 16 are connected to each other by sucking action of the vacuum means 36 and the punched holes having the same shape can be punched simultaneously at the same positions in each of the areas E.

Since the present invention has been constituted as described above, it is possible to provide newly a multiaxis punch device in which each of punched holes having different shapes such as a round punched hole, a rectangular punched hole, an elliptical punched hole or the like, for example is punched simultaneously for respective holes by a grid pattern punch system at each of the locations of the same position in each of the areas defined in the work.

Accordingly, it is possible to eliminate a problem of a mounting space in which the entire machine is made large in size to occupy substantially a space as found in a system in which the device moves between the prior art multiaxis punch devices or between the monoaxis punch devices, a problem of showing a high facility cost and a problem showing a deterioration in productivity due to high amount of motion of the work and the like.

In addition, since only the punches are inserted into and fitted to the punch holder in such a way that they are struck with a hammer, it becomes possible to arrange multi pins having some punches under a mutual approached relation even if there is provided either the guide sleeve for guiding each of the punches in coaxial with each of the punches or the returning spring, so that it is possible to have a multi-punched hole punch function in which multi-type punch holes are punched simultaneously at each of the locations of the same positions in each of the areas defined in the work for each of the holes by selecting the type of punches for each of the unit groups held by the punch holder.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

[Description of the Reference Symbols]

| | | | |
|---|---|---|---|
| A: | multiaxis punch device | 4: | punch holder |
| 2: | die holder | Z: | punch |
| 5: | hammer holder | H: | hammer |
| 13: | servo motor | 242: | returning spring |
| 3: | punch drive source | T: | group of units |
| Z1: | round punch | Z2: | rectangular punch |
| Z3: | ellipsoidal punch | Z4: | large diameter round punch |

What is claimed is:

1. A multiaxis punch device comprising:

a punch holder having a plurality of punches arranged therein and supported by springs to provide returning motion, said punch holder being arranged above a die holder in such a manner that the punch holder can be moved up and down, wherein the plurality of punches are arranged in plural groups within the punch holder, each of the groups including plural punches having different shapes, the punches within each group being arranged in a pattern such that punches having the same shape are located at the same position within each of the groups;

a hammer holder arranged above said punch holder and having a plurality of hammers for selectively striking against the punches, wherein the plurality of hammers are arranged on the hammer holder such that each hammer is positioned above a punch located in the same position within each of the groups;

a punch drive source is mounted above the hammer holder; and a movement mechanism configured to move said hammer holder horizontally above said punch holder when said punch drive source is not driven, said movement mechanism selectively positioning said hammer holder such that the hammers are positioned above selective punches located in the same position within each of the groups.

2. The multiaxis punch device according to claim 1, wherein said movement mechanism includes at least one cylinder configured to move said hammer holder in a horizontal direction.

3. The multiaxis punch device according to claim 1, wherein said movement mechanism includes at least two transversely arranged cylinders configured to move said hammer holder in transverse horizontal directions.

4. The multiaxis punch device according to claim 1, wherein said movement mechanism is configured to move said hammer holder in transverse horizontal directions.

5. The multiaxis punch device according to claim 1, wherein said hammer holder includes at least one sidewall groove, and said movement mechanism includes at least one lifter configured to selectively enter the at least one groove.

6. The multiaxis punch device according to claim 5, wherein the at least one sidewall groove is a V-groove and the at least one lifter includes a slanted surface configured to engage the V-groove.

7. The multiaxis punch device according to claim 5, wherein said movement mechanism further includes at least one cylinder configured to move the at least one lifter toward and away from said hammer holder for engagement in the at least one sidewall groove.

8. The multiaxis punch device according to claim 5, wherein the at least one lifter is mounted on a slider configured to move in a direction parallel to the at least one sidewall groove.

9. The multiaxis punch device according to claim 1, further comprising a connecting mechanism configured to selectively connect said punch drive source and said hammer holder.

10. The multiaxis punch device according to claim 9, wherein said connecting mechanism includes a vacuum source that provides a vacuum between said punch drive source and said hammer holder in a connected condition.

11. The multiaxis punch device according to claim 10, wherein said connecting mechanism further includes an O-ring.

12. The multiaxis punch device according to claim 9, wherein said connecting mechanism is configured to connect said punch drive source and said hammer holder when said punch drive source is driven, and to disconnect said punch drive source and said hammer holder when said movement mechanism moves said hammer holder.

* * * * *